US007108493B2

(12) United States Patent
Clements et al.

(10) Patent No.: US 7,108,493 B2
(45) Date of Patent: Sep. 19, 2006

(54) VARIABLE DISPLACEMENT PUMP HAVING ROTATING CAM RING

(75) Inventors: Martin A. Clements, North Royalton, OH (US); Lowell D. Hansen, Sagamore Hills, OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 10/474,225

(22) PCT Filed: Mar. 27, 2002

(86) PCT No.: PCT/US02/09298

§ 371 (c)(1),
(2), (4) Date: Oct. 3, 2003

(87) PCT Pub. No.: WO02/081921

PCT Pub. Date: Oct. 17, 2002

(65) Prior Publication Data

US 2004/0136853 A1 Jul. 15, 2004

(51) Int. Cl.
*F03C 2/00* (2006.01)
*F04C 14/18* (2006.01)

(52) U.S. Cl. ..... 418/30; 418/1; 418/31; 418/152; 418/173

(58) Field of Classification Search ..... 418/1, 418/30, 31, 152, 173
See application file for complete search history.

(56) References Cited

U.S. PATENT DOCUMENTS 1,671,240 A 5/1928 Gurley
1,728,321 A * 9/1929 Leonida ..... 418/30
2,241,824 A 5/1941 Meyerhoefer
2,509,256 A 5/1950 Sorensen
2,589,449 A 3/1952 Stageberg
2,685,256 A 8/1954 Humphreys
2,782,724 A 2/1957 Humphreys
2,918,877 A 12/1959 Woodcock
2,938,469 A 5/1960 Lauck
3,134,334 A 5/1964 Smith
3,143,079 A 8/1964 Carner
3,415,058 A * 12/1968 Underwood et al. ..... 418/30
3,656,869 A 4/1972 Leonard
3,744,939 A 7/1973 Grennan et al.
4,354,809 A 10/1982 Sundberg
4,564,344 A 1/1986 Sakamaki et al.
4,595,347 A 6/1986 Sakamaki et al.
4,620,837 A 11/1986 Sakamaki et al.
5,064,361 A 11/1991 Kristof et al.
5,090,881 A 2/1992 Suzuki et al.
5,141,418 A 8/1992 Ohtaki et al.
5,259,186 A 11/1993 Snow (Continued)

FOREIGN PATENT DOCUMENTS

DE 33 33 647 A1 5/1984

(Continued)

*Primary Examiner*—Theresa Trieu
(74) *Attorney, Agent, or Firm*—Fay, Sharpe, Fagan, Minnich & McKee, LLP

(57) ABSTRACT

Vane pump (10) mechanical losses are reduced by removing vane friction losses and replacing them with lower magnitude journal bearing fluid film viscous drag losses. A freely rotating cam ring (70) is supported by a journal bearing (80). A relatively low sliding velocity is imposed between the cam ring and the vanes (26). This permits the use of less expensive and less brittle materials in the pump by allowing the pump to operate at much higher speeds without concern for exceeding vane tip velocity limits.

16 Claims, 4 Drawing Sheets

U.S. PATENT DOCUMENTS

| | | | |
|---|---|---|---|
| 5,305,597 | A | 4/1994 | Snow |
| 5,366,354 | A | 11/1994 | Yuge |
| 5,378,112 | A | 1/1995 | Nasvytis |
| 5,388,607 | A | 2/1995 | Ramaker et al. |
| 5,484,271 | A | 1/1996 | Stich |
| 5,488,969 | A | 2/1996 | King et al. |
| 5,518,380 | A | 5/1996 | Fujii et al. |
| 5,715,674 | A | 2/1998 | Reuter et al. |
| 5,716,201 | A | 2/1998 | Peck et al. |
| 5,738,500 | A | 4/1998 | Sundberg et al. |
| 5,806,300 | A | 9/1998 | Veilleux, Jr. et al. |
| 5,873,351 | A | 2/1999 | Vars et al. |
| 5,983,621 | A | 11/1999 | Stambaugh, Sr. et al. |
| 6,016,832 | A | 1/2000 | Vars et al. |
| 6,022,201 | A | 2/2000 | Kasmer |
| 6,102,001 | A | 8/2000 | McLevige |
| 6,120,256 | A | 9/2000 | Miyazawa |
| 6,155,797 | A | 12/2000 | Kazuyoshi |
| 6,217,296 | B1 | 4/2001 | Miyazawa et al. |
| 6,375,441 | B1 | 4/2002 | Ichizuki et al. |
| 6,402,487 | B1 | 6/2002 | Clements et al. |
| 6,412,271 | B1 | 7/2002 | Maker et al. |
| 2001/0033797 | A1 | 10/2001 | Gretzschel et al. |
| 2001/0036412 | A1 | 11/2001 | Konishi |
| 2002/0007820 | A1 | 1/2002 | Davies et al. |

FOREIGN PATENT DOCUMENTS

| | | | |
|---|---|---|---|
| DE | 33 07 099 | A1 | 9/1984 |
| DE | 88 14 553 | U | 3/1990 |
| DE | 40 11 671 | A1 | 10/1991 |
| DE | 42 01 257 | A1 | 7/1993 |
| DE | 44 28 410 | A1 | 2/1996 |
| DE | 198 47 275 | A1 | 3/2000 |
| DE | 199 57 886 | A1 | 7/2000 |
| DE | 100 04 028 | A1 | 8/2000 |
| DE | 199 15 739 | A1 | 10/2000 |
| DE | 101 20 252 | A1 | 1/2002 |
| EP | 0 049 838 | A1 | 4/1982 |
| EP | 0 095 194 | | 11/1983 |
| EP | 0 135 091 | A1 | 3/1985 |
| EP | 0 171 182 | A1 | 2/1986 |
| EP | 0 171 183 | A1 | 2/1986 |
| EP | 0 210 786 | A1 | 2/1987 |
| EP | 1 043 504 | A2 | 10/2000 |
| FR | 2195271 | | 3/1974 |
| FR | 2802983 | | 6/2001 |
| GB | 687998 | | 2/1953 |
| GB | 572736 | | 10/1956 |
| GB | 984255 | | 2/1965 |
| GB | 1224265 | | 3/1971 |
| GB | 1328728 | | 8/1973 |
| GB | 1341414 | | 12/1973 |
| GB | 1341415 | | 12/1973 |
| GB | 1 374 597 | | 11/1974 |
| GB | 1 435 556 | | 5/1976 |
| GB | 2016087 | A | 9/1979 |
| GB | 2 026 094 | A | 1/1980 |
| GB | 2 074 274 | A | 10/1981 |
| GB | 2 126 657 | A | 3/1984 |
| GB | 2313092 | A | 6/1984 |
| GB | 2 151 705 | A | 7/1985 |
| GB | 2 167 811 | A | 6/1986 |
| GB | 2 185 535 | A | 7/1987 |
| JP | 59 188077 | A | 10/1984 |
| WO | WO 90/08900 | | 8/1990 |
| WO | WO 00/20760 | | 4/2000 |
| WO | WO 01/65118 | A1 | 9/2001 |

* cited by examiner

VARIABLE DISPLACEMENT PUMP HAVING ROTATING CAM RING

BACKGROUND OF THE INVENTION

The present invention relates to a pump, and more specifically to a high-speed vane pump that finds particular use in fuel pumps, metering, and control for jet engines.

Current vane pumps use one or more stationary, or non-rotating, cam rings. Outer radial tips of the vanes slide along the cam rings. The rings are not, however, free to rotate relative to the housing. The stationary cam rings are rigidly fixed to a pump housing in a fixed displacement pump, or the cam ring moves or pivots to provide variable displacement capability. Thus, as will be-appreciated by one skilled in the art, these types of positive displacement pumps include a stator or housing having inlet and outlet ports, typically at locations diametrically offset relative to an axis of rotation of a rotor received in a pump chamber. Plural, circumferentially spaced and radially extending guides or vanes extend outwardly from the rotor. Since the rotor axis is offset and parallel to an axis of the housing chamber, the offset relationship of the axes causes the vanes to move radially inward and outward relative to the rotor during rotation.

Outer tips of the vanes contact the cam ring and the contact forces of the individual vanes, usually numbering from six to twelve, impose frictional drag forces on the cam ring. These drag forces convert directly into mechanical losses that reduce the overall efficiency of the pump. In many applications, these mechanical drag losses far exceed the theoretical power to pump the fluid.

When used in the jet engine environment, for example, vane pumps use materials that are of generally high durability and wear resistance due to the high velocity and loading factors encountered by these vane pumps. Parts manufactured from these materials generally cost more to produce and suffer from high brittleness. For example, tungsten carbide is widely used as a preferred material for vane pump components used in jet engines. Tungsten carbide is a very hard material that finds particular application in the vane, cam ring, and side plates. However, tungsten carbide is approximately two and one-half (2½) times the cost of steel, for example, and any flaw or overstress can result in cracking and associated problems. In addition, the ratio of the weight of tungsten carbide relative to steel is approximately 1.86 so that weight becomes an important consideration for these types of applications. Thus, although the generally high durability and wear resistance make tungsten carbide suitable for the high velocity and loading factors in vane pumps, the weight, cost, and high brittleness associated therewith results in a substantial increase in overall cost.

Even using special materials such as tungsten carbide, current vane pumps are somewhat limited in turning speed. The limit relates to the high vane tip sliding velocity relative to the cam ring. Even with tungsten carbide widely used in the vane pump, high speed pump operation over 12,000 RPM is extremely difficult.

Improved efficiencies in the pump are extremely desirable, and increased efficiencies in conjunction with increased reliability and the ability to use a vane-type pump for other applications are desired.

SUMMARY OF THE INVENTION

An improved gas turbine fuel pump exhibiting increased efficiency and reliability is provided by the present invention.

More particularly, the gas turbine fuel pump includes a housing having a pump chamber and an inlet and outlet in fluid communication with the chamber. A rotor is received in the pump chamber and a cam member surrounds the rotor and is freely rotatable relative to the housing.

A journal bearing is interposed between the cam member and the housing for reducing mechanical losses during operation of the pump.

The journal bearing is a continuous annular passage defined between the cam member and the housing.

The rotor includes circumferentially spaced vanes having outer radial tips in contact with the cam member.

The pump further includes a cam sleeve pivotally secured within the housing to selectively vary the eccentricity between the cam member and the rotor.

The gas turbine fuel pump exhibits dramatically improved efficiencies over conventional vane pumps that do not employ the freely rotating cam member.

The fuel pump also exhibits improved reliability at a reduced cost since selected components can be formed of a reasonably durable, less expensive material.

The improved efficiencies also permit the pump to be smaller and more compact which is particularly useful for selected applications where size is a critical feature.

Still other benefits and advantages of the invention will become apparent to one skilled in the art upon reading the following detailed description.

DETAILED DESCRIPTION OF THE PREFERRED EMBODIMENTS

Figure 1:
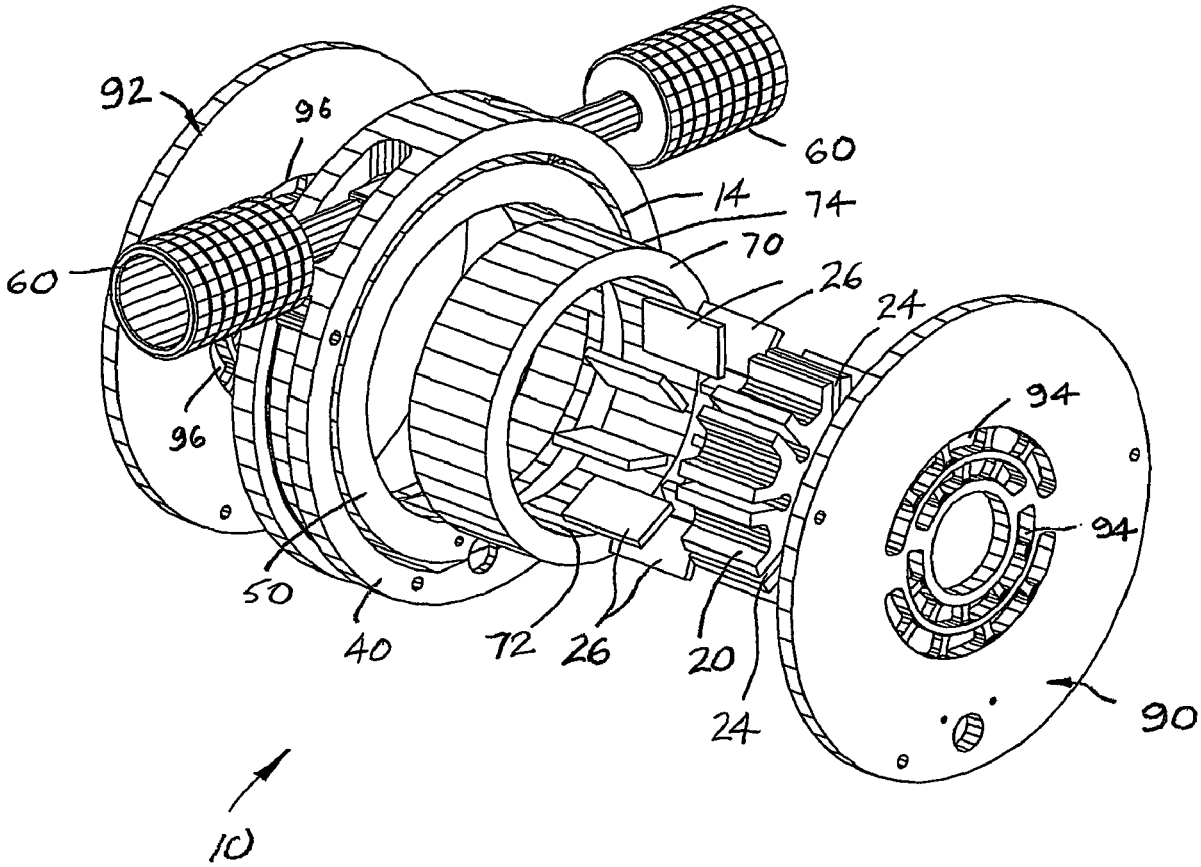
FIG. 1 is an exploded perspective view of a preferred embodiment of the fluid pump.
Figure 2:
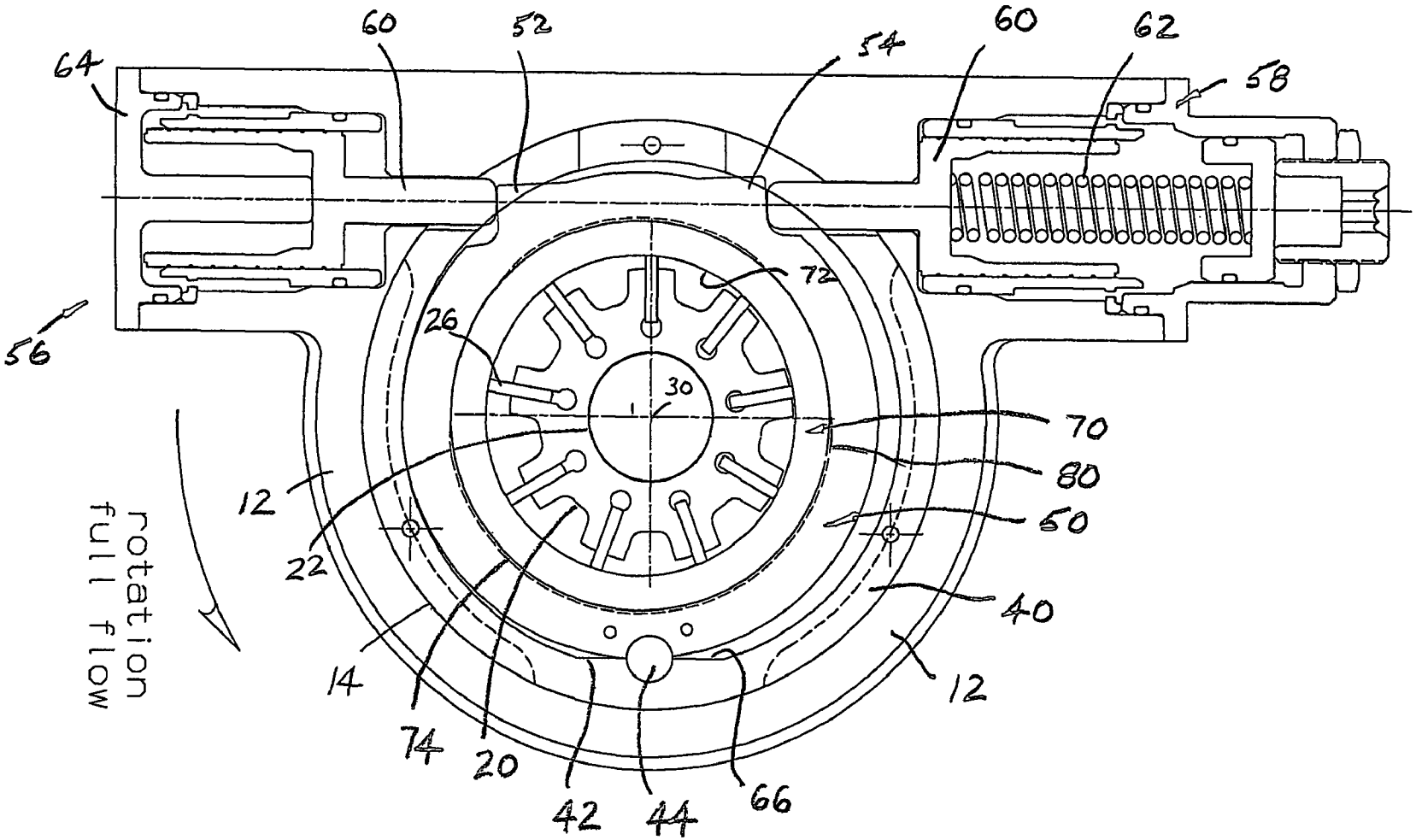
FIG. 2 is a cross-sectional view through the assembled pump of FIG. 1.

As shown in the Figures, a pump assembly 10 includes a housing 12 having a pump chamber 14 defined therein. Rotatably received in the chamber is a rotor 20 secured to a shaft 22 for rotating the rotor within the chamber. Peripherally or circumferentially spaced about the rotor are a series of radially extending grooves 24 that operatively receive blades or vanes 26 having outer radial tips that extend from the periphery of the rotor. The vanes may vary in number, for example, nine (9) vanes are shown in the embodiment of FIG. 2, although a different number of vanes can be used without departing from the scope and intent of the present invention. As is perhaps best illustrated in FIG. 2, the rotational axis of the shaft 22 and rotor 20 is referenced by numeral 30. Selected vanes (right-hand vanes shown in FIG. 2) do not extend outwardly from the periphery of the rotor to as great an extent as the remaining vanes (left-hand vanes in FIG. 2) as the rotor rotates within the housing chamber. Pumping chambers are defined between each of the vanes as the vanes rotate in the pump chamber with the rotor and provide positive displacement of the fluid.

With continued reference to FIG. 2, a spacer ring 40 is rigidly secured in the housing and received around the rotor at a location spaced adjacent the inner wall of the housing chamber. The spacer ring has a flat or planar cam rolling surface 42 and receives an anti-rotation pin 44. The pin pivotally receives a cam sleeve 50 that is non-rotatably received around the rotor. First and second lobes or actuating surfaces 52, 54 are provided on the sleeve, typically at a location opposite the anti-rotation pin. The lobes cooperate with first and second actuator assemblies 56, 58 to define means for altering a position of the cam sleeve 50. The altering means selectively alter the stroke or displacement of the pump in a manner well known in the art. For example, each actuator assembly includes a piston 60, biasing means such as spring 62, and a closure member 64 so that in response to pressure applied to a rear face of the pistons, actuating lobes of the cam sleeve are selectively moved. This selective actuation results in rolling movement of the cam sleeve along a generally planar or flat surface 66 located along an inner surface of the spacer ring adjacent on the pin 44. It is desirable that the cam sleeve undergo a linear translation of the centerpoint, rather than arcuate movement, to limit pressure pulsations that may otherwise arise in seal zones of the assembly. In this manner, the center of the cam sleeve is selectively offset from the rotational axis 30 of the shaft and rotor when one of the actuator assemblies is actuated and moves the cam sleeve (FIG. 2). Other details of the cam sleeve, actuating surface, and actuating assemblies are generally well known to those skilled in the art so that further discussion herein is deemed unnecessary.

Received within the cam sleeve is a rotating cam member or ring 70 having a smooth, inner peripheral wall 72 that is contacted by the outer tips of the individual vanes 26 extending from the rotor. An outer, smooth peripheral wall 74 of the cam ring is configured for free rotation within the cam sleeve 50. More particularly, a journal bearing 80 supports the rotating cam ring 70 within the sleeve. The journal bearing is filled with the pump fluid, here jet fuel, and defines a hydrostatic or hydrodynamic, or a hybrid hydrostatic/hydrodynamic bearing. The frictional forces developed between the outer tips of the vanes and the rotating cam ring 70 result in a cam ring that rotates at approximately the same speed as the rotor, although the cam ring is free to rotate relative to the rotor since there is no structural component interlocking the cam ring for rotation with the rotor. It will be appreciated that the ring rotates slightly less than the speed of the rotor, or even slightly greater than the speed of the rotor, but due to the support/operation in the fluid film bearing, the cam ring possesses a much lower magnitude viscous drag. The low viscous drag of the cam ring substitutes for the high mechanical losses exhibited by known vane pumps that result from the vane frictional losses contacting the surrounding stationary ring. The drag forces resulting from contact of the vanes with the cam ring are converted directly into mechanical losses that reduce the pumps overall efficiency. The cam ring is supported solely by the journal bearing 80 within the cam sleeve. The journal bearing is a continuous passage. That is, there is no interconnecting structural component such as roller bearings, pins, or the like that would adversely impact on the benefits obtained by the low viscous drag of the cam ring. For example, flooded ball bearings would not exhibit the improved efficiencies offered by the journal bearing, particularly a journal bearing that advantageously uses the pump fluid as the fluid bearing.

In prior applications these mechanical drag losses can far exceed the mechanical power to pump the fluid in many operating regimes of the jet engine fuel pump. As a result, there was a required use of materials having higher durability and wear resistance because of the high velocity and load factors in these vane pumps. The material weight and manufacturing costs were substantially greater, and the materials also suffer from high brittleness. The turning speed of those pumps was also limited due to the high vane sliding velocities relative to the cam ring. Even when using special materials such as tungsten carbide, high speed pump operation, e.g., over 12,000 RPM, was extremely difficult.

These mechanical losses resulting from friction between the vane and cam ring are replaced in the present invention with much lower magnitude viscous drag losses. This results from the ability of the cam ring to rotate with the rotor vanes. A relatively low sliding velocity between the cam ring and vanes results, and allows the manufacturer to use less expensive, less brittle materials in the pump. This provides for increased reliability and permits the pump to be operated at much higher speeds without the concern for exceeding tip velocity limits. In turn, higher operating speeds result in smaller displacements required for achieving a given flow. In other words, a smaller, more compact pump can provide similar flow results as a prior larger pump. The pump will also have an extended range of application for various vane pump mechanisms.

Figure 3:
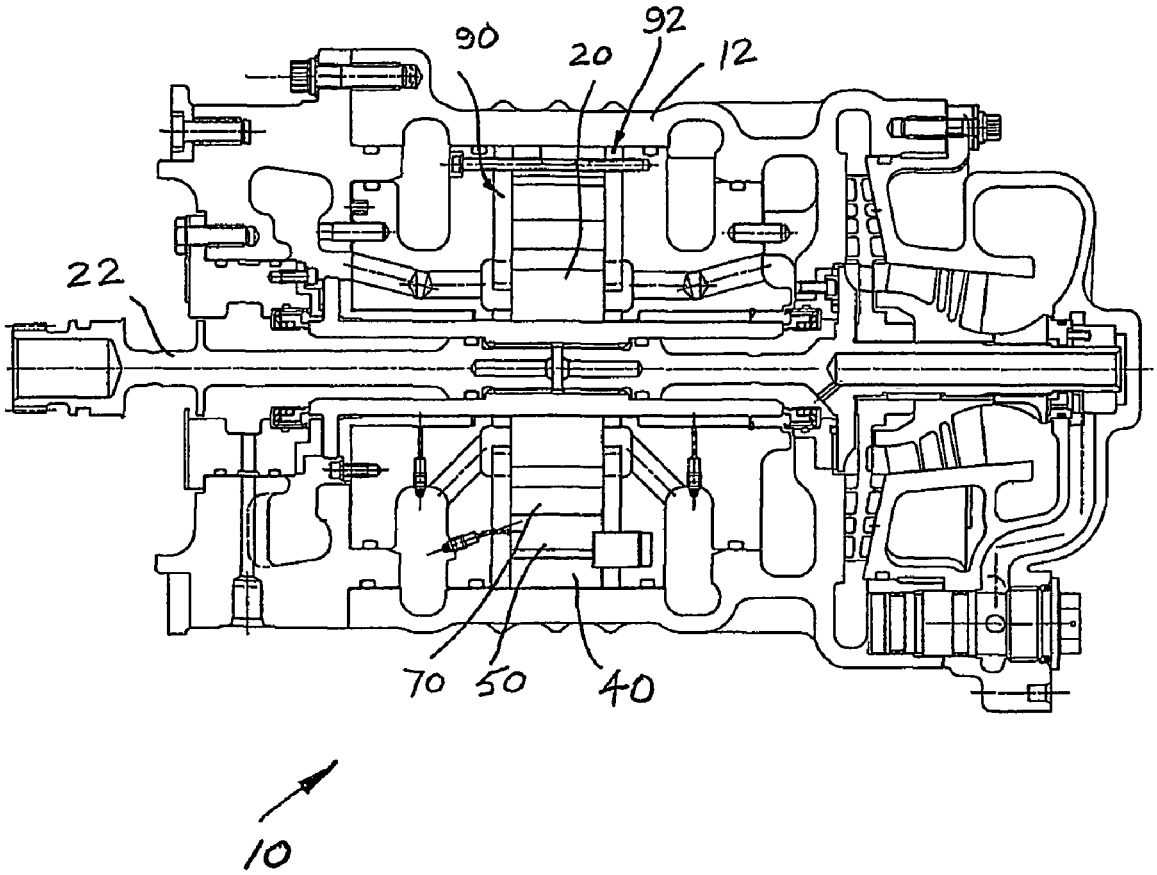
FIG. 3 is a longitudinal cross-sectional view through the assembled pump.

FIG. 3 more particularly illustrates inlet and outlet porting about the rotor for providing an inlet and outlet to the pump chamber. First and second plates 90, 92 have openings 94, 96, respectively. Energy is imparted to the fluid by the rotating vanes. Jet fuel, for example, is pumped to a desired downstream use at an elevated pressure.

Figure 4:
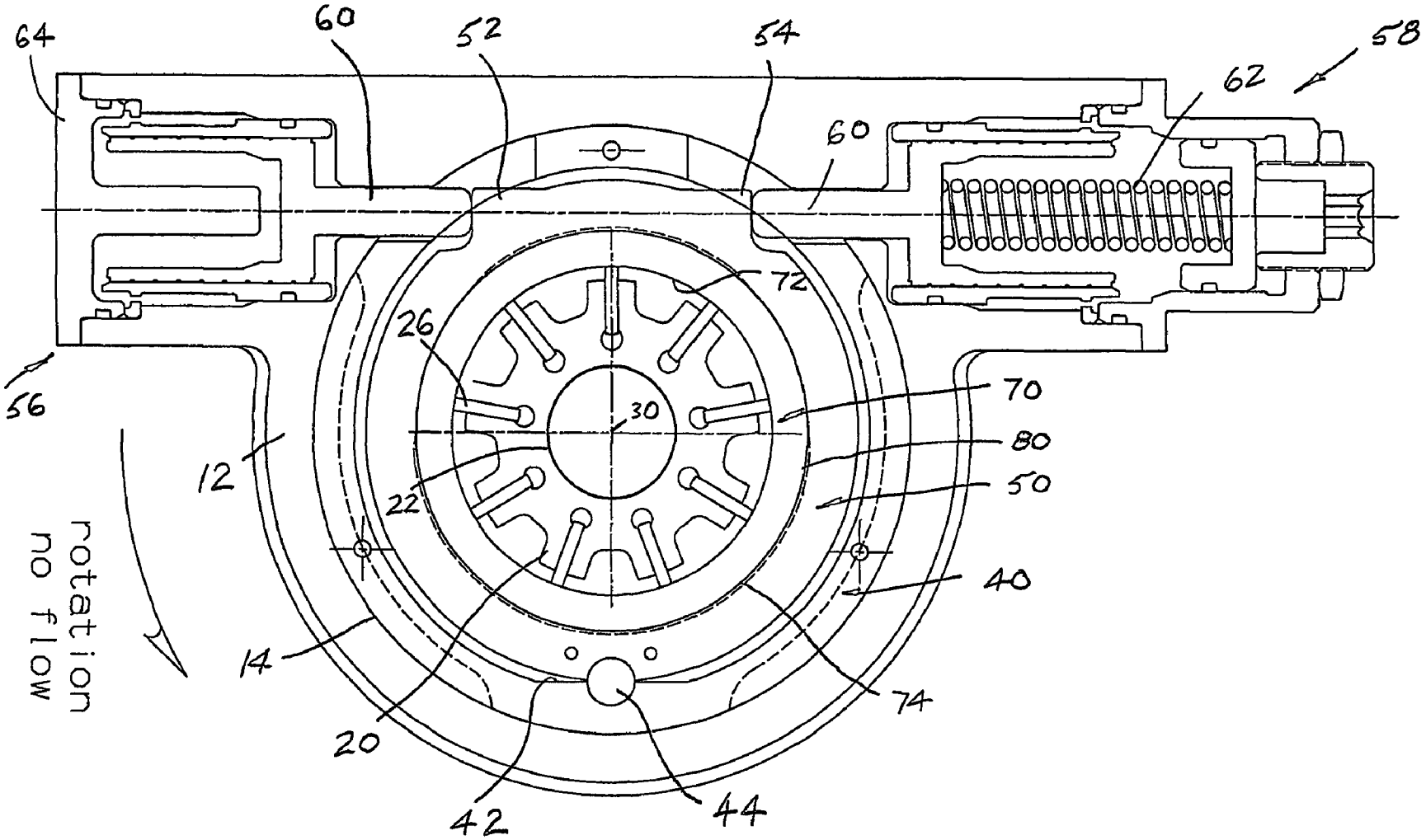
FIG. 4 is a cross-sectional view similar to FIG. 2 illustrating a variable displacement pump with the support ring located in a second position.

As shown in FIG. 4, neither of the actuating assemblies is pressurized so that the cam sleeve is not pivoted to vary the stroke of the vane pump. That is, this no flow position of FIG. 4 can be compared to FIG. 2 where the cam sleeve 50 is pivoted about the pin 44 so that a close clearance is defined between the cam sleeve and the spacer ring 40 along the left-hand quadrants of the pump as illustrated in the Figure. This provides for variable displacement capabilities in a manner achieved by altering the position of the cam sleeve.

In the preferred arrangement, the vanes are still manufactured from a durable, hard material such as tungsten carbide. The cam ring and side plates, though, are alternately formed of a low cost, durable material such as steel to reduce the weight and manufacturing costs, and allow greater reliability. Of course, it will be realized that if desired, all of the components can still be formed of more expensive durable materials such as tungsten carbide and still achieve substantial efficiency benefits over prior arrangements. By using the jet fuel as the fluid that forms the journal bearing, the benefits of tungsten carbide for selected components and steel for other components of the pump assembly are used to advantage. This is to be contrasted with using oil or similar hydraulic fluids as the journal bearing fluid where it would be necessary for all of the jet fuel components to be formed from steel, thus eliminating the opportunity to obtain the benefits offered by using tungsten carbide.

The invention has been described with reference to the preferred embodiments. Obviously, modifications and alterations will occur to others upon reading and understanding the preceding detailed description. It is intended that the invention be construed as including all such modifications and alterations in so far as they come within the scope of the appended claims or the equivalents thereof.

The invention claimed is:

1. A variable displacement gas turbine fuel pump comprising:

a housing having a pump chamber, and an inlet and outlet in fluid communication with the pump chamber;

a rotor received in the pump chamber;

a cam member surrounding the rotor and freely rotating relative to the housing;

a cam sleeve radially interposed between the cam member and the housing;

means for altering a position of the cam sleeve in the housing to selectively vary pump output;

a spacer ring radially interposed between the cam sleeve and the housing wherein the spacer ring includes a generally planar cam sleeve rolling surface that allows a centerpoint of the cam sleeve to linerarly translate; and a journal bearing interposed between the cam member and the cam sleeve for reducing mechanical losses during operation of the pump.

2. The fuel pump of claim 1 wherein the cam member has a smooth, inner peripheral wall that allows the rotor to rotate freely relative to the cam member.

3. The fuel pump of claim 1 wherein the journal bearing is a continuous annular passage between the cam member and the cam sleeve.

4. The fuel pump of claim 1 further comprising circumferentially spaced vanes operatively associated with the rotor.

5. The fuel pump of claim 1 wherein the journal bearing is a hydrostatic bearing.

6. The fuel pump of claim 1 wherein the journal bearing is a hydrodynamic bearing.

7. The fuel pump of claim 1 wherein the journal bearing is a hybrid hydrostatic/hydro dynamic bearing.

8. A variable displacement gas turbine fuel pump for supplying jet fuel from a supply to a set of downstream nozzles, the gas turbine fuel pump comprising:

a housing having a fuel inlet and a fuel outlet in operative communication with a pump chamber;

a rotor received in the pump chamber, the rotor having plural vanes that segregate the pump chamber into individual pump chamber portions;

a cam ring received around the rotor having radially inner and outer surfaces, the inner surface slidingly engaging the vanes;

a cam sleeve radially interposed between the cam ring and the housing;

a spacer ring radially interposed between the cam sleeve and the housing, the cam sleeve being secured to the spacer ring to selectively vary eccentricity between the cam ring and the rotor;

means for altering a position of the cam sleeve in the housing to selectively vary pump output; and a cam journal bearing surrounding the cam ring in communication with the fuel inlet whereby jet fuel serves as the fluid film in the journal bearing for the cam ring, wherein the journal bearing is a continuous annular passage between the cam ring and the cam sleeve.

9. The fuel pump of claim 8 wherein the journal bearing is a hydrodynamic bearing.

10. The fuel pump of claim 8 wherein the journal bearing is a hydrostatic bearing.

11. The fuel pump of claim 8 wherein the journal bearing is a hybrid hydrostatic/hydrodynamic bearing.

12. The fuel pump of claim 8 wherein a center of the cam sleeve enclosing the cam ring is selectively offset from a rotational axis of the rotor.

13. The fuel pump of claim 8 further comprising circumferentially spaced vanes operatively associated with the rotor.

14. The fuel pump of claim 8 wherein the vanes are formed of tungsten carbide.

15. The fuel pump of claim 8 wherein the cam ring is formed of a low cost, durable material.

16. A method of operating a gas turbine fuel pump that includes a housing having a pump chamber that receives a rotor therein and a cam member surrounding the rotor, a cam sleeve surrounding the cam member and a spacer ring disposed between the cam sleeve and the housing, a generally planar cam rolling surface along an inner surface thereof adjacent an anti-rotation pin interconnecting the spacer ring and the cam sleeve, and upon which the cam sleeve rolls in response to actuation of the altering means, the method comprising the steps of:

supporting the cam member via a journal bearing disposed between the cam member and the cam sleeve in the housing;

allowing the rotor to rotate freely relative to the cam member; and linearly translating a centerpoint of the cam sleeve to limit pressure pulsations in seal zones of the assembly.

* * * * *